US008079885B1

(12) United States Patent
Lin

(10) Patent No.: US 8,079,885 B1
(45) Date of Patent: Dec. 20, 2011

(54) WATERPROOF CONNECTOR AND FEMALE TERMINAL THEREIN

(75) Inventor: Chih-Hsin Lin, Xianxi Township, Changhua County (TW)

(73) Assignee: K.S. Terminals Inc., Changhua County (TW)

( * ) Notice: Subject to any disclaimer, the term of this patent is extended or adjusted under 35 U.S.C. 154(b) by 0 days.

(21) Appl. No.: 12/856,306

(22) Filed: Aug. 13, 2010

(30) Foreign Application Priority Data

Jul. 20, 2010 (TW) ..... 99213801 U

(51) Int. Cl.
*H01R 13/54* (2006.01)

(52) U.S. Cl. ..... 439/851

(58) Field of Classification Search ..... 439/851, 439/852

See application file for complete search history.

(56) References Cited

U.S. PATENT DOCUMENTS 4,447,108 A * 5/1984 Ghigliotti et al. ..... 439/851
4,840,587 A * 6/1989 Lancella ..... 439/851
4,840,588 A * 6/1989 Lancella ..... 439/851
5,820,423 A * 10/1998 Hsu ..... 439/851
6,875,063 B2 * 4/2005 Zhao et al. ..... 439/851
7,201,617 B2 * 4/2007 Okamoto et al. ..... 439/851
7,387,548 B2 * 6/2008 Takehara et al. ..... 439/843

* cited by examiner

*Primary Examiner* — Gary F. Paumen

(74) *Attorney, Agent, or Firm* — Ming Chow; Sinorica, LLC

(57) ABSTRACT

A female terminal of a connector has a connection end for connecting with the core of a cable and a contact end for being inserted by a slender male terminal and making electrical contact therewith. The contact end includes a hollow cylinder whose two ends are connected to a neck and formed with an opening, respectively, and whose inner diameter ranges from 3.0 mm to 6.0 mm. The middle section of the hollow cylinder is provided with a plurality of resilient strips extending along an axial direction of the hollow cylinder, such that a slot is formed between each two adjacent resilient strips. Each resilient strip has two ends connected to the hollow cylinder and is 4.5 mm to 12.5 mm in length and 0.5 mm to 1.1 mm in width. Each resilient strip has a central portion deflected toward the axis of the hollow cylinder by a displacement ranging from 0.2 mm to 0.8 mm.

20 Claims, 5 Drawing Sheets

WATERPROOF CONNECTOR AND FEMALE TERMINAL THEREIN

BACKGROUND OF THE INVENTION

1. Technical Field

The present invention relates to the terminals of a connector. More particularly, the present invention relates to the female terminal of a connector, wherein the female terminal is made of metal and is configured for being inserted by a slender male terminal so as to make electrical contact therewith.

2. Description of Related Art

"Connectors" as used herein refer to connecting elements and accessories thereof that are configured to enable transmission of electronic signals and/or electrical power. The quality of a connector is critical not only to the reliability of current and signal transmission but also to the operation of an electronic system equipped with the connector. Nowadays, connectors are extensively used in different industries and a variety of mechanical/electronic equipment to convey data, signals, and power rapidly.

Factors influencing the quality of a connector abound, and the key factor lies in the female terminal. The female terminal must have a small volume, be able to guide the insertion of a male terminal, and apply an appropriate, resilient clamping force to the inserted male terminal to ensure physical contact and electrical conduction, wherein the tightness of contact between the male and female terminals determines the quality of electrical conduction.

If the male terminal is inserted in the female terminal but not firmly connected therewith, the male terminal is likely to get loose, thus resulting in poor electrical connection, low contact strength, and insufficient current conduction. Should this happen, current or signal transmission would be hindered, and hence the operation of the related electronic system or mechanical/electronic equipment adversely affected.

BRIEF SUMMARY OF THE INVENTION

To overcome the aforesaid drawback of the prior art, the present invention provides a female terminal of a connector, wherein the female terminal has a contact end and a connection end away from the contact end. The connection end is configured to connect with the core of a cable. The contact end is configured to be inserted by a slender male terminal and make electrical contact therewith. In addition, a neck is provided between the contact end and the connection end and has a relatively small diameter.

The contact end includes a hollow cylinder. The hollow cylinder has one end directly connected to the neck and the other end formed with an opening. The middle section of the hollow cylinder is provided with a plurality of resilient strips extending along an axial direction of the hollow cylinder, thus forming a slot between each two adjacent resilient strips. Each resilient strip is connected to the hollow cylinder at both ends and has a central portion deflected toward the axis of the hollow cylinder. Preferably, each resilient strip has a length ranging from 4.5 mm to 12.5 mm and a width ranging from 0.5 mm to 1.1 mm. Moreover, the displacement by which each resilient strip is deflected toward the axis of the hollow cylinder is preferably between 0.2 mm and 0.8 mm, and the hollow cylinder preferably has an inner diameter between 3.0 mm and 6.0 mm.

Therefore, the primary object of the present invention is to provide a female terminal of a connector, wherein the female terminal has a contact end and a connection end. The contact end includes a hollow cylinder. The hollow cylinder has a middle section formed with a plurality of resilient strips extending along an axial direction of the hollow cylinder. The preferable ranges of the length and width of each resilient strip and of the deflection displacement of each resilient strip toward the axis of the hollow cylinder are determined by experiments so that, by virtue of the plural resilient strips, the female terminal can apply a strong clamping force to a male terminal inserted therein to ensure secure connection between the male and female terminals. Also, the contact strength of the male and female terminals is increased to enhance electrical connection.

A secondary object of the present invention is to provide a female terminal of a connector, wherein the female terminal has a contact end and a connection end, the contact end including a hollow cylinder, the hollow cylinder having a middle section formed with a plurality of resilient strips extending along an axial direction of the hollow cylinder, and each resilient strip being connected to the hollow cylinder at both ends. Thus, the current conduction path between the female terminal and a male terminal in contact therewith is shortened to enhance current conduction.

The present invention further provides a waterproof connector, wherein the waterproof connector includes an insulating housing and a female terminal provided in the insulating housing.

Therefore, it is another object of the present invention to provide a waterproof connector, wherein the waterproof connector includes a female terminal having a contact end and a connection end. The contact end includes a hollow cylinder. The middle section of the hollow cylinder is formed with a plurality of resilient strips extending along an axial direction of the hollow cylinder. The preferable ranges of the length and width of each resilient strip and of the deflection displacement of each resilient strip toward the axis of the hollow cylinder are determined by experiments so that, by virtue of the plural resilient strips, the female terminal can apply a strong clamping force to a male terminal inserted therein to ensure secure connection between the male and female terminals. Also, the contact strength of the male and female terminals is increased to enhance electrical connection.

It is yet another object of the present invention to provide a waterproof connector, wherein the waterproof connector includes a female terminal having a contact end and a connection end, the contact end including a hollow cylinder, the hollow cylinder having a middle section formed with a plurality of resilient strips extending along an axial direction of the hollow cylinder, and each resilient strip being connected to the hollow cylinder at both ends. Thus, the current conduction path between the female terminal and a male terminal in contact therewith is shortened to enhance current conduction.

BRIEF DESCRIPTION OF THE SEVERAL VIEWS OF THE DRAWINGS

The structure and technical means adopted by the present invention to achieve the above and other objects can be best understood by referring to the following detailed description of the preferred embodiments and the accompanying drawings, in which.

DETAILED DESCRIPTION OF THE INVENTION

The present invention discloses a female terminal of a connector and a waterproof connector using the same female terminal, wherein the principles of connection and electrical conduction between the male and female terminals of a connector are well known to a person of ordinary skill in the art and hence are not be detailed herein. Besides, it should be understood that the drawings referred to in the following description are not necessarily drawn to scale, for they are intended to demonstrate the features of the present invention only schematically.

Figure 1:
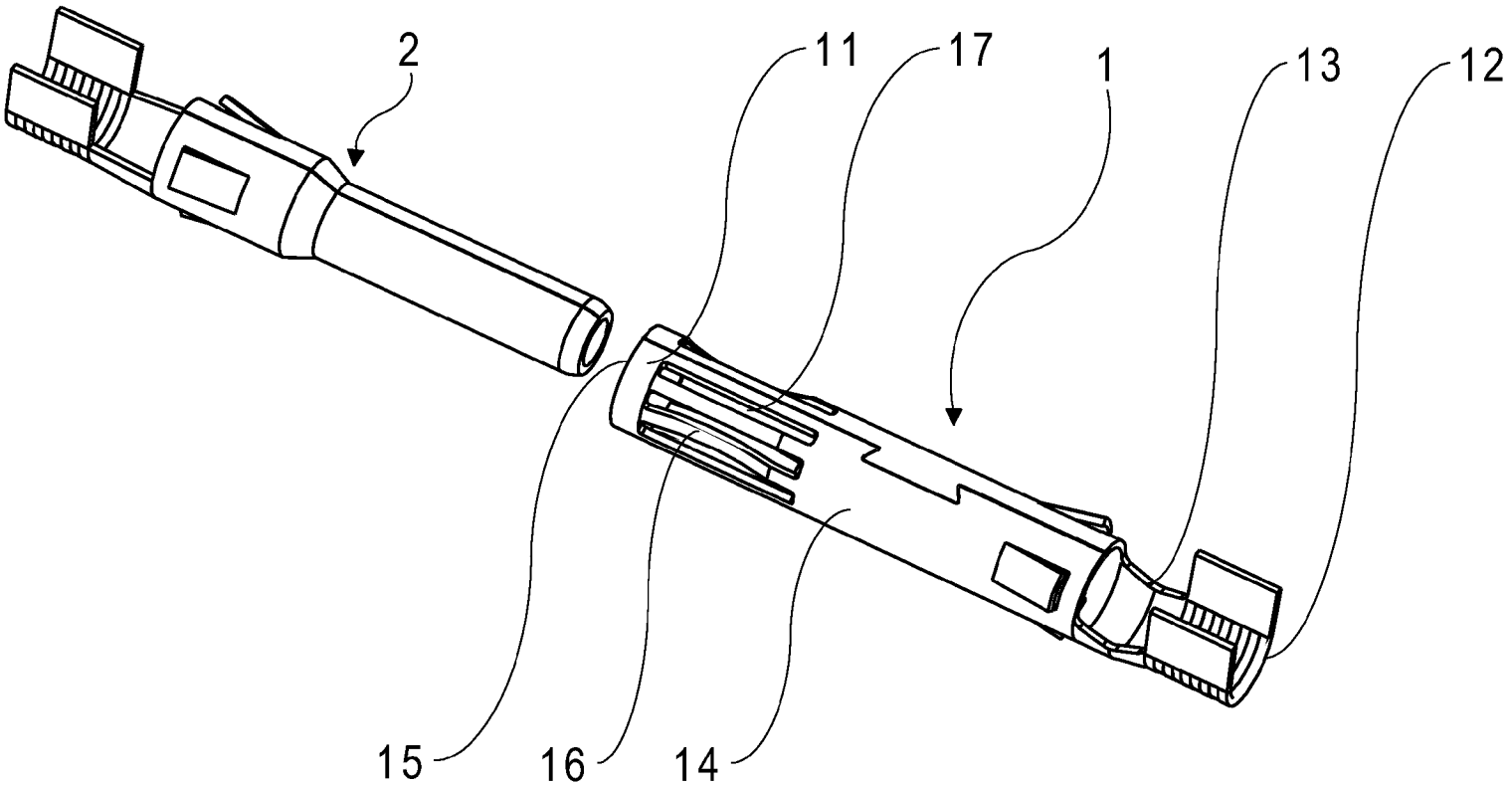
FIG. 1 is a perspective view of a female terminal and a male terminal of a waterproof connector according to a first preferred embodiment of the present invention.

Referring to FIG. 1 for a first preferred embodiment of the present invention, a female terminal 1 of a connector is integrally formed by pressing a metal plate with a die and has a contact end 11 and a connection end 12 away from the contact end 11. The connection end 12 is configured to connect with the core of a cable (not shown) while the contact end 11 is configured to be inserted by a slender male terminal 2 and make electrical contact therewith. In addition, a neck 13 having a relatively small diameter is provided between the contact end 11 and the connection end 12. Preferably, the female terminal 1 is made of copper or a copper alloy. Alternatively, the female terminal 1 can be made of tin, lead, nickel, gold, silver, bismuth, or an alloy of the aforesaid metals, depending on practical needs.

Figure 2:
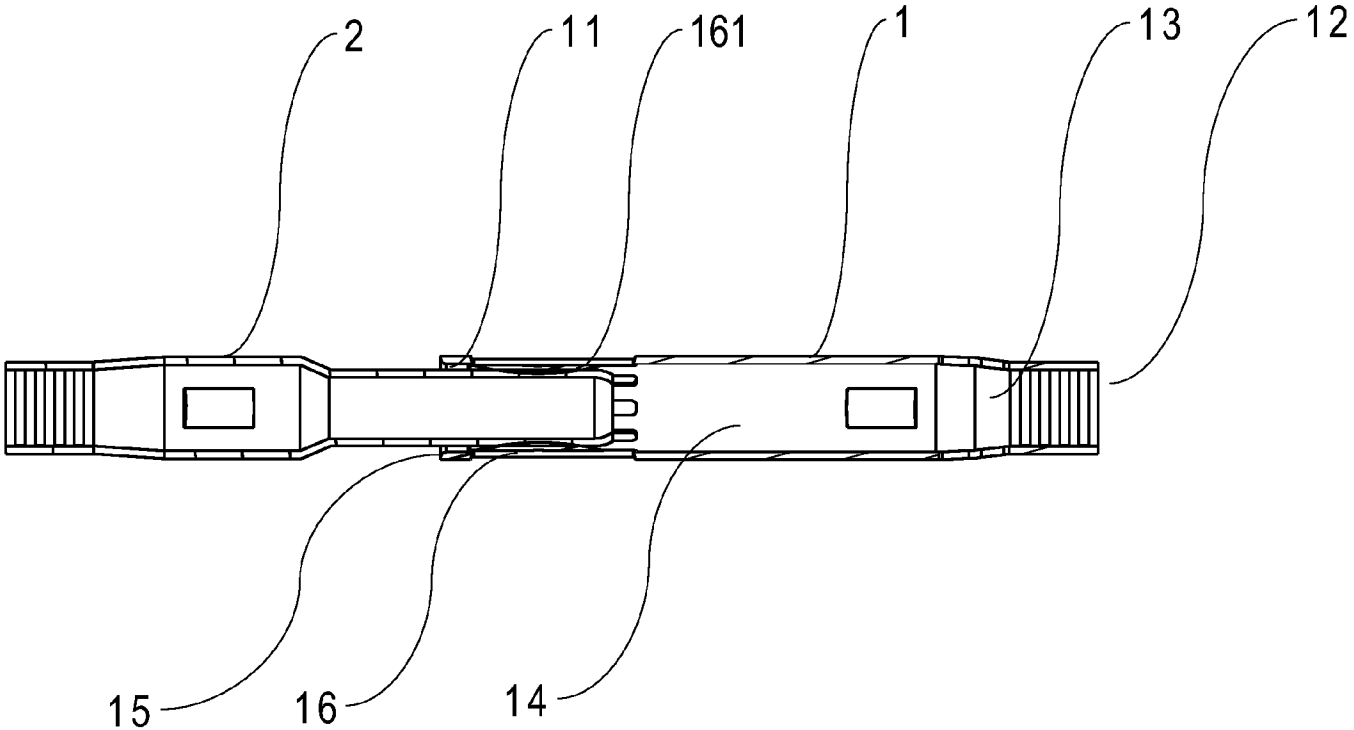
FIG. 2 is a sectional view showing connection between the male and female terminals depicted in FIG. 1.

As shown in FIG. 1, the contact end 11 of the female terminal 1 includes a hollow cylinder 14. The hollow cylinder 14 has one end directly coupled to the neck 13 and the other end formed with an opening 15, wherein the opening 15 is the entrance through which the male terminal 2 is inserted into the contact end 11. The middle section of the hollow cylinder 14 is formed with a plurality of resilient strips 16 that extend along an axial direction of the hollow cylinder 14, and in consequence a slot 17 is formed between each two adjacent resilient strips 16. Each resilient strip 16 has two ends that are connected to the hollow cylinder 14. Each resilient strip 16 further has a central portion deflected toward the axis of the hollow cylinder 14. Referring to FIG. 2 for a sectional view showing connection between the female terminal 1 and the male terminal 2, the central portion of each resilient strip 16 is deflected toward the axis of the hollow cylinder 14 to form a deflected portion 161. The plural deflected portions 161 render the female terminal 1 resilient and serve to clamp the inserted male terminal 2 resiliently. The number of the resilient strips 16 is preferably three to six, which is determined by experimentation. If there are only two resilient strips 16, the male terminal 2 will not be effectively clamped by the resilient strips 16 and may get loose from the female terminal 1. However, if there are more than six resilient strips 16, the width W of each resilient strip 16 may become so small that the clamping force of each resilient strip 16 is reduced.

Figure 3:
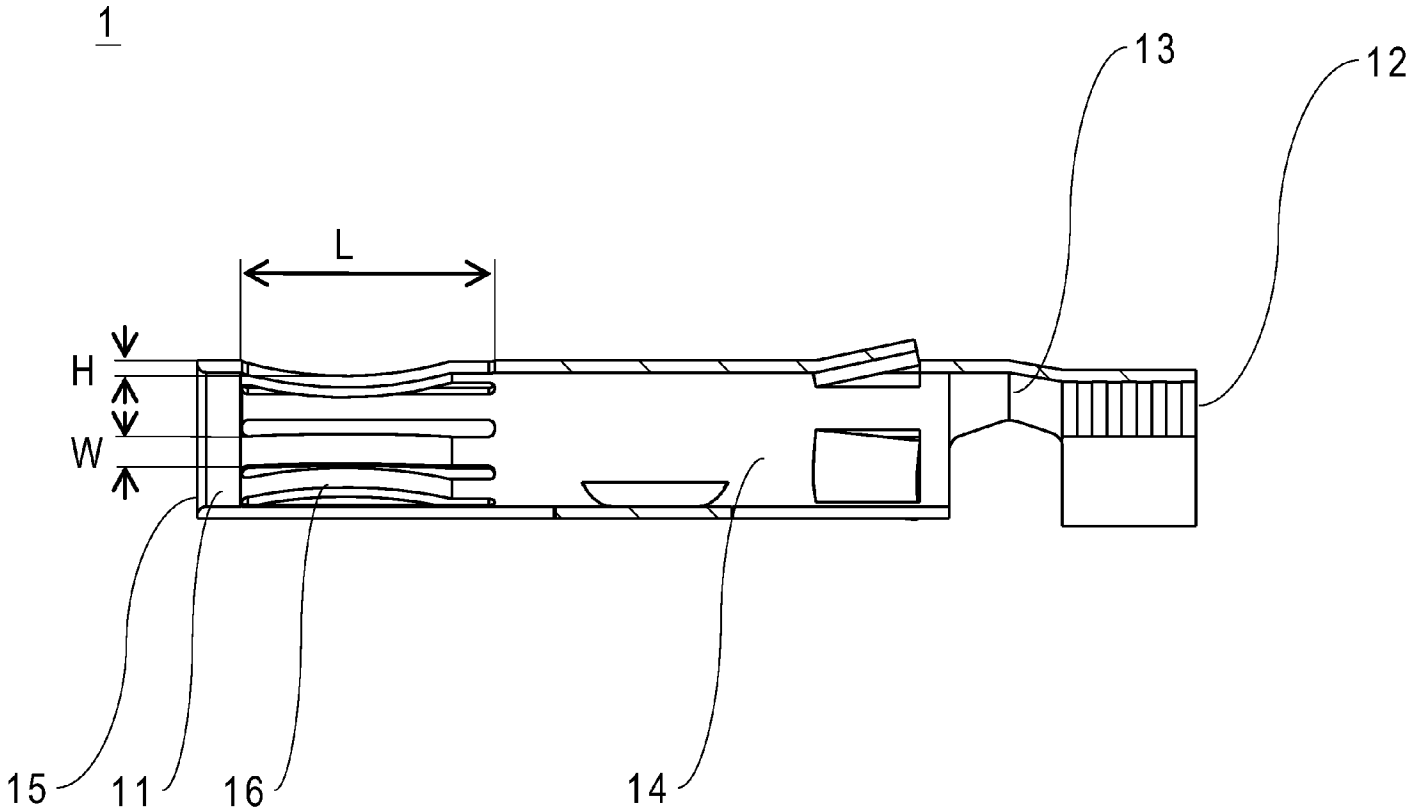
FIG. 3 is a sectional view of the female terminal depicted in FIG. 1.

With reference to FIG. 3, each resilient strip 16 of the female terminal 1 preferably has a length L ranging from 4.5 mm to 12.5 mm, while the width W of each resilient strip 16 is preferably between 0.5 mm and 1.1 mm. Furthermore, the displacement H by which each resilient strip 16 is deflected toward the axis of the hollow cylinder 14 is preferably between 0.2 mm and 0.8 mm. It should be pointed out that the strong clamping force provided by the female terminal 1 of the present invention relies on the aforesaid preferable numerical ranges of the length L, width W, and displacement H of each resilient strip 16. If the length L, width W, and displacement H of each resilient strip 16 go beyond the aforesaid numerical ranges, the clamping force of the female terminal 1 will be compromised.

Figure 4:
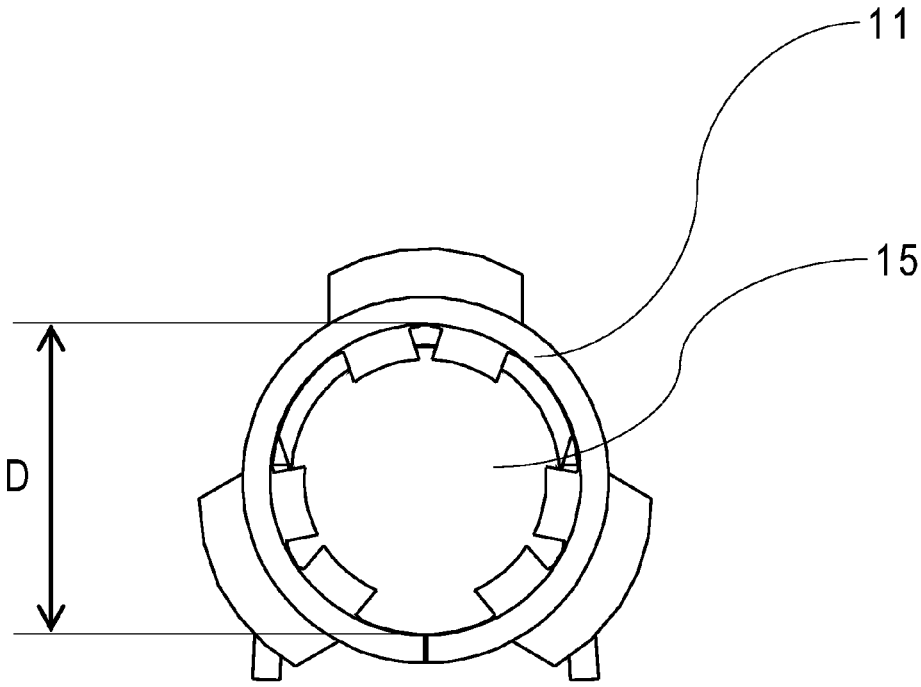
FIG. 4 is a plane view of the female terminal of FIG. 1 when viewed from the contact end.

Please refer to FIG. 4 for a plane view of the female terminal 1 as viewed from the contact end 11. In this preferred embodiment, the hollow cylinder 14 of the female terminal 1 has an inner diameter D ranging from 3.0 mm to 6.0 mm so as to provide a suitable space in the female terminal 1 that facilitates insertion of the male terminal 2.

It should be noted that if the length L of each resilient strip 16 is too short, the resilient strips 16 will be stiff and lose their resilience, thus reducing the clamping force of the female terminal 1. On the other hand, if the length L of each resilient strip 16 is too long, the contact between the male terminal 2 and the female terminal 1 will be impaired, for the arm of force of each resilient strip 16 will be so long that the resilient strips 16 tend to dangle in the hollow cylinder 14. Also, an excessive length L will lengthen the conduction path between the male terminal 2 and the female terminal 1 in contact therewith, which is unfavorable to current conduction. By the same token, the resilience and clamping force of each resilient strip 16 will be adversely affected if the width W or the displacement H of each resilient strip 16 is too large or too small.

More preferably, the number of the resilient strips 16 is six, the length L of each resilient strip 16 is 8.5 mm, the width W of each resilient strip 16 is 0.8 mm, the displacement H by which each resilient strip 16 is deflected toward the axis of the hollow cylinder 14 is 0.5 mm, and the inner diameter D of the hollow cylinder 14 is 4.5 mm. A female terminal 1 having the foregoing dimensions can provide an even stronger clamping force. The six resilient strips 16 enable the female terminal 1 to apply an increased clamping force to the inserted male terminal 2 to ensure secure connection between the male terminal 2 and the female terminal 1. Meanwhile, the contact strength of the male terminal 2 and the female terminal 1 is also increased to provide better electrical connection. However, it is understood that the number of the resilient strips 16; the length L, width W, and displacement H of each resilient strip 16; and the inner diameter D of the hollow cylinder 14 may vary according to practical needs within the ranges specified above for the present preferred embodiment.

Besides, the width W of each resilient strip 16 of the female terminal 1 is preferably uniform or is reduced in the central portion of each resilient strip 16 as needed. What is important in this preferred embodiment is that the two ends of each resilient strip 16 are connected to the hollow cylinder 14 to shorten the current conduction path, and thereby enhance current conduction, between the male terminal 2 and the female terminal 1 in contact therewith.

Figure 5:
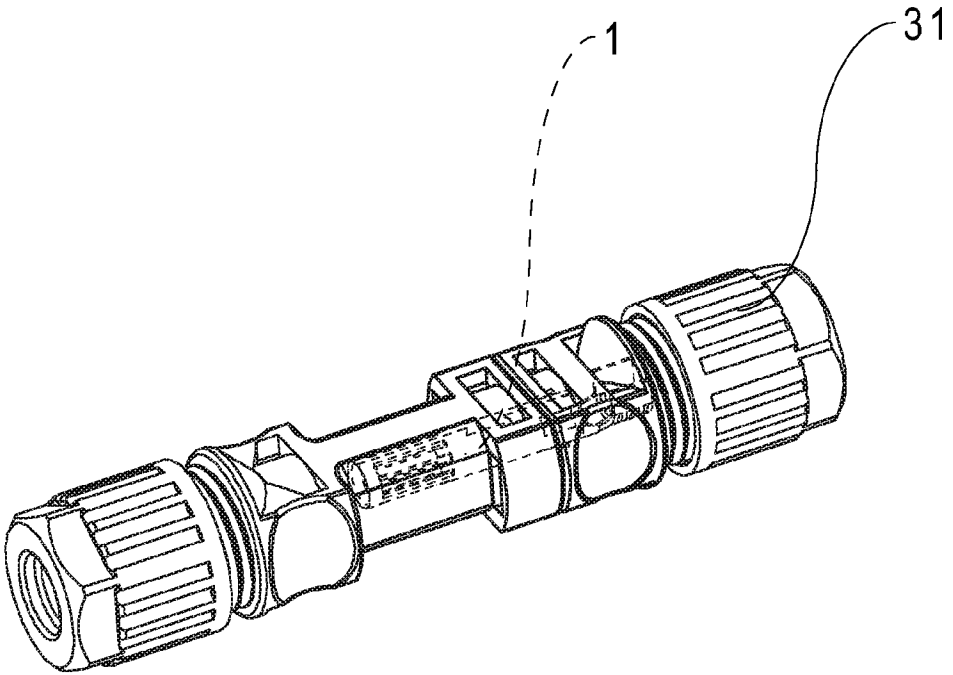
FIG. 5 is a perspective view of a waterproof connector assembly according to a second preferred embodiment of the present invention.

In addition, to achieve the objects previously mentioned, a waterproof connector 3 having a female terminal 1 is disclosed herein as a second preferred embodiment of the present invention and is shown in FIG. 5 in a perspective view. The waterproof connector 3 includes an insulating housing 31 and the female terminal 1 disposed in the insulating housing 31. The characteristics and functions of the female terminal 1 in this preferred embodiment are substantially the same as those of the female terminal 1 in the first preferred embodiment and hence are not described repeatedly herein.

The embodiments described above are only the preferred embodiments but are not intended to limit the scope of the present invention. As the disclosure of the present invention should be easily understood and implemented by a person skilled in the art, all equivalent changes or modifications which do not depart from the spirit of the present invention should be encompassed by the appended claims.

What is claimed is:

1. A female terminal (1) of a connector, the female terminal (1) having a contact end (11) and a connection end (12) away from the contact end (11), the connection end (12) being configured to connect with a core of a cable, the contact end (11) being configured to be inserted by a slender male terminal (2) and make electrical contact therewith, there being a neck (13) located between the contact end (11) and the connection end (12) and having a relatively small diameter, the female terminal (1) being characterized in that:

the contact end (11) comprises a hollow cylinder (14), the hollow cylinder (14) having an end directly connected to the neck (13) and an opposite end formed with an opening (15), the hollow cylinder (14) having a middle section formed with a plurality of resilient strips (16) extending along an axial direction of the hollow cylinder (14), such that a slot (17) is formed between each two adjacent said resilient strips (16), each said resilient strip (16) having two ends connected to the hollow cylinder (14), each said resilient strip (16) having a central portion deflected toward an axis of the hollow cylinder (14) to form a deflected portion (161), wherein:

the plural deflected portions (161) thereby renders the female terminal (1) resilient and serves to clamp the slender male terminal (2) resiliently;

each said resilient strip (16) has a length (L) ranging from 4.5 mm to 12.5 mm and a width (W) ranging from 0.5 mm to 1.1 mm and is deflected toward the axis of the hollow cylinder (14) by a displacement (H) ranging from 0.2 mm to 0.8 mm, and the hollow cylinder (14) has an inner diameter (D) ranging from 3.0 mm to 6.0 mm.

2. The female terminal (1) of claim 1, wherein the number of said resilient strips (16) ranges from three to six.

3. The female terminal (1) of claim 2, wherein the number of said resilient strips (16) is six.

4. The female terminal (1) of claim 1, wherein the length (L) of each said resilient strip (16) is 8.5 mm.

5. The female terminal (1) of claim 1, wherein the width (W) of each said resilient strip (16) is 0.8 mm.

6. The female terminal (1) of claim 1, wherein the displacement (H) by which each said resilient strip (16) is deflected toward the axis of the hollow cylinder (14) is 0.5 mm.

7. The female terminal (1) of claim 1, wherein the inner diameter (D) of the hollow cylinder (14) is 4.5 mm.

8. The female terminal (1) of claim 1, wherein the width (W) of each said resilient strip (16) is uniform.

9. The female terminal (1) of claim 1, wherein the width (W) is reduced in the central portion of each said resilient strip (16).

10. The female terminal (1) of claim 1, wherein the female terminal (1) is made of copper or a copper alloy.

11. A waterproof connector (3), comprising an insulating housing (31) and the female terminal (1), the female terminal (1) having a contact end (11) and a connection end (12) away from the contact end (11), the connection end (12) being configured to connect with a core of a cable, the contact end (11) being configured to be inserted by a slender male terminal (2) and make electrical contact therewith, there being a neck (13) located between the contact end (11) and the connection end (12) and having a relatively small diameter, the female terminal (1) being characterized in that:

the contact end (11) comprises a hollow cylinder (14), the hollow cylinder (14) having an end directly connected to the neck (13) and an opposite end formed with an opening (15), the hollow cylinder (14) having a middle section formed with a plurality of resilient strips (16) extending along an axial direction of the hollow cylinder (14), such that a slot (17) is formed between each two adjacent said resilient strips (16), each said resilient strip (16) having two ends connected to the hollow cylinder (14), each said resilient strip (16) having a central portion deflected toward an axis of the hollow cylinder (14) to form a deflected portion (161), wherein:

the plural deflected portions (161) thereby renders the female terminal (1) resilient and serves to clamp the slender male terminal (2) resiliently; and each said resilient strip (16) has a length (L) ranging from 4.5 mm to 12.5 mm and a width (W) ranging from 0.5 mm to 1.1 mm and is deflected toward the axis of the hollow cylinder (14) by a displacement (H) ranging from 0.2 mm to 0.8 mm, and the hollow cylinder (14) has an inner diameter (D) ranging from 3.0 mm to 6.0 mm.

12. The waterproof connector (3) of claim 11, wherein the number of said resilient strips (16) ranges from three to six.

13. The waterproof connector (3) of claim 12, wherein the number of said resilient strips (16) is six.

14. The waterproof connector (3) of claim 11, wherein the length (L) of each said resilient strip (16) is 8.5 mm.

15. The waterproof connector (3) of claim 11, wherein the width (W) of each said resilient strip (16) is 0.8 mm.

16. The waterproof connector (3) of claim 11, wherein the displacement (H) by which each said resilient strip (16) is deflected toward the axis of the hollow cylinder (14) is 0.5 mm.

17. The waterproof connector (3) of claim 11, wherein the inner diameter (D) of the hollow cylinder (14) is 4.5 mm.

18. The waterproof connector (3) of claim 11, wherein the width (W) of each said resilient strip (16) is uniform.

19. The waterproof connector (3) of claim 11, wherein the width (W) is reduced in the central portion of each said resilient strip (16).

20. The waterproof connector (3) of claim 11, wherein the female terminal (1) is made of copper or a copper alloy.

* * * * *